United States Patent [19]

Rudnicki

[11] Patent Number: 4,896,580

[45] Date of Patent: Jan. 30, 1990

[54] RAILROAD MISSILE GARRISON SYSTEM

[75] Inventor: Ron Rudnicki, Lisbon, Iowa

[73] Assignee: Rockwell International Corporation, El Segundo, Calif.

[21] Appl. No.: 287,938

[22] Filed: Dec. 21, 1988

[51] Int. Cl.[4] ..... F41H 13/00

[52] U.S. Cl. ..... 89/1.815; 89/1.11; 340/991; 364/461

[58] Field of Search ..... 340/991, 992, 994, 47, 340/48, 53; 364/426.05, 461; 89/1.815, 1.11; 105/394

[56] References Cited

U.S. PATENT DOCUMENTS

| | | | |
|---|---|---|---|
| 2,606,281 | 8/1952 | Thomas et al. | 340/47 |
| 2,762,913 | 9/1956 | Jepson | 340/992 |
| 3,448,433 | 6/1969 | McCune | 340/47 |
| 4,235,402 | 11/1980 | Matty et al. | 364/426.05 |
| 4,361,202 | 11/1982 | Minovitch | 180/168 |
| 4,361,301 | 11/1982 | Rush | 340/47 |
| 4,379,497 | 4/1983 | Hainsworth et al. | 180/168 |
| 4,401,035 | 8/1983 | Spigarelli et al. | 364/426.05 |
| 4,410,154 | 10/1983 | Matty | 364/426.05 |
| 4,573,396 | 3/1986 | Streetman et al. | 89/1.815 |
| 4,625,279 | 11/1986 | Zuber et al. | 340/47 |
| 4,701,760 | 10/1987 | Raoux | 340/993 |
| 4,706,195 | 11/1987 | Yoshino et al. | 364/461 |

FOREIGN PATENT DOCUMENTS

| | | | |
|---|---|---|---|
| 2556864 | 6/1985 | France | 340/992 |
| 11512 | 1/1977 | Japan | 364/426.05 |
| 70508 | 6/1979 | Japan | 340/47 |

OTHER PUBLICATIONS

Cooper, Communications (U.S.A.)(10/70), Remote Car Control, pp. 14,16–19.

Bollinger, Railway Signaling and Communications (12/67), Welco Working on BARTO Signaling, pp. 18–23.

*Primary Examiner*—Charles T. Jordan

*Assistant Examiner*—Stephen Johnson

*Attorney, Agent, or Firm*—Gregory G. Williams; M. Lee Murrah; H. Fredrick Hamann

[57] ABSTRACT

An improved railroad missile garrison system, which helps to reduce the dangers to the civilian population, by providing a computerized system for issuing track warrants to missile trains, and other non military trains, and by providing for remote intervention of the throttle and brake functions on the missile train locomotives.

1 Claim, 2 Drawing Sheets

RAILROAD MISSILE GARRISON SYSTEM

BACKGROUND OF THE INVENTION

The present invention relates to railroads, and more particularly concerns a railroad missile garrison, and even more particularly concerns a computer controlled railroad missile garrison system.

In the past, it has been proposed to deploy Intercontinental Ballistic Missiles (ICBM's) in a rail garrison mode. One proposal has been to use trains, each having at least one car with a launch ready ICBM thereon, and other support cars as necessary. It has been proposed to operate these trains on existing rail over an expansive geographic region, so as to make them a much more difficult target for enemy attack. It is also proposed to maintain and operate these trains so that they are indistinguishable from other normal or nonmilitary trains already operating on the rail systems.

While this proposal has numerous beneficial aspects, and has met with widespread acceptance, it does have several serious drawbacks. One major problem is the danger presented to the local civilian population in the event of a train accident. With the ultra-hazardous cargo of these trains, it is imperative that they not be involved in accidents, such as collisions between trains or a derailing of the train due to operating the train at improper speeds for the terrain and track conditions. In both such accident types, the danger of the armed missile being thrown from the train into the surrounding countryside, is a distinct and disturbing possibility.

Consequently, there exists a need for improvement and advancement in the designs of rail missile garrison systems.

SUMMARY OF THE INVENTION

It is an object of the present invention to greatly increase the safety of the operation of a rail missile garrison on existing rails for the local civilian population.

It is a feature of the present invention to include apparatus to assure positive train separation.

It is an advantage of the present invention to substantially reduce the likelihood of collisions between trains.

It is another feature of the present invention to include electronic apparatus to aid in controlling the locomotive based upon data received from onboard sensors and also from data transmitted from sources external to the train.

It is an advantage of the present invention to reduce the likelihood of a train derailment caused by operating a train at excessive speeds.

The present invention provides an improved railroad missile garrison system which is designed to satisfy the aforementioned needs, produce the earlier propounded objects, include the above described features and achieve the already articulated advantages. The invention is carried out in a "collision-less" and a "derailment-less" system, in the sense that the likelihood of a collision between trains is greatly reduced while concomitantly the likelihood of a missile train derailment due to excessive train speeds is also reduced.

Accordingly, the present invention includes an improved railroad missile garrison system which includes a locomotive, at least one missile launch car having a launch ready ICBM thereon, onboard locomotive sensor and control systems, a digital communication system for transmitting digital data to and from the locomotive relating to track configurations, other rail traffic, locomotive status, locomotive position, etc., and the communication system being capable of directly manipulating the onboard control systems.

BRIEF DESCRIPTION OF THE DRAWINGS FIG. 1 is a schematic representation of an improved railroad missile garrison system of the present invention which shows a train with a launch car thereon approaching along a main track having a siding containing an awaiting nonmilitary train.

FIG. 2 is a schematic representation of the improved railroad missile garrison system of the present invention with the area within the large intermittent line enclosure, representing apparatus physically located on the missile garrison locomotive.

DETAILED DESCRIPTION OF THE DRAWINGS

Figure 1:
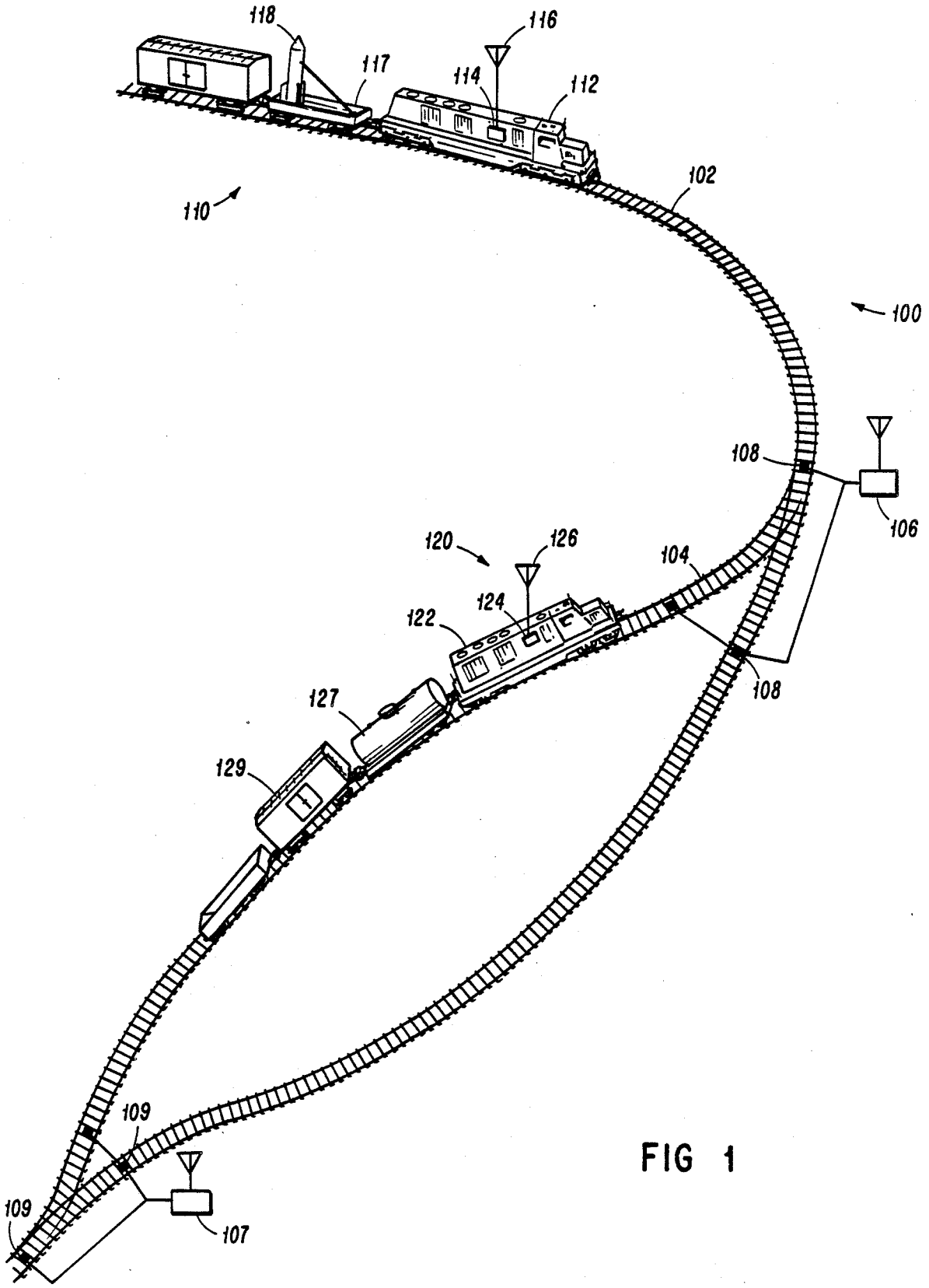

Now referring to FIG. 1, there is shown an improved railroad missile garrison system, of the present invention, generally designated 100, which shows a main railroad track 102 having an adjoining siding 104 connecting therewith. A missile garrison train 110 is shown operating along main rail track 102. Train 110 is shown having a missile garrison locomotive 112 having a sensor, control and communication system 114 therein which is coupled with an antenna 116. Launch car 117 having a launch ready ICBM is shown coupled with locomotive 112. Nonmilitary train 120 is shown having a locomotive 122 having a sensor and communication system 124 therein which is coupled with antenna 126. Train 120 further having cars 127 and 129 coupled with locomotive 120. Train 120 is shown clearly positioned in the siding 104 so that missile garrison train 110 can proceed along the main track 102 without interruption. Essentially, the positive train separation is achieved by providing the crew and onboard automatic control systems with data relating to the speed, position, length, etc., their own train and others nearby. Sensors 108, for sensing the passage of a locomotive, are coupled with transceiver 106. Similarly, also shown are sensors 109 coupled with transceiver 107. These sensors are able to detect the location of the train 120 in the siding 104, while the transceivers communicate that information to various users about the system.

Figure 2:
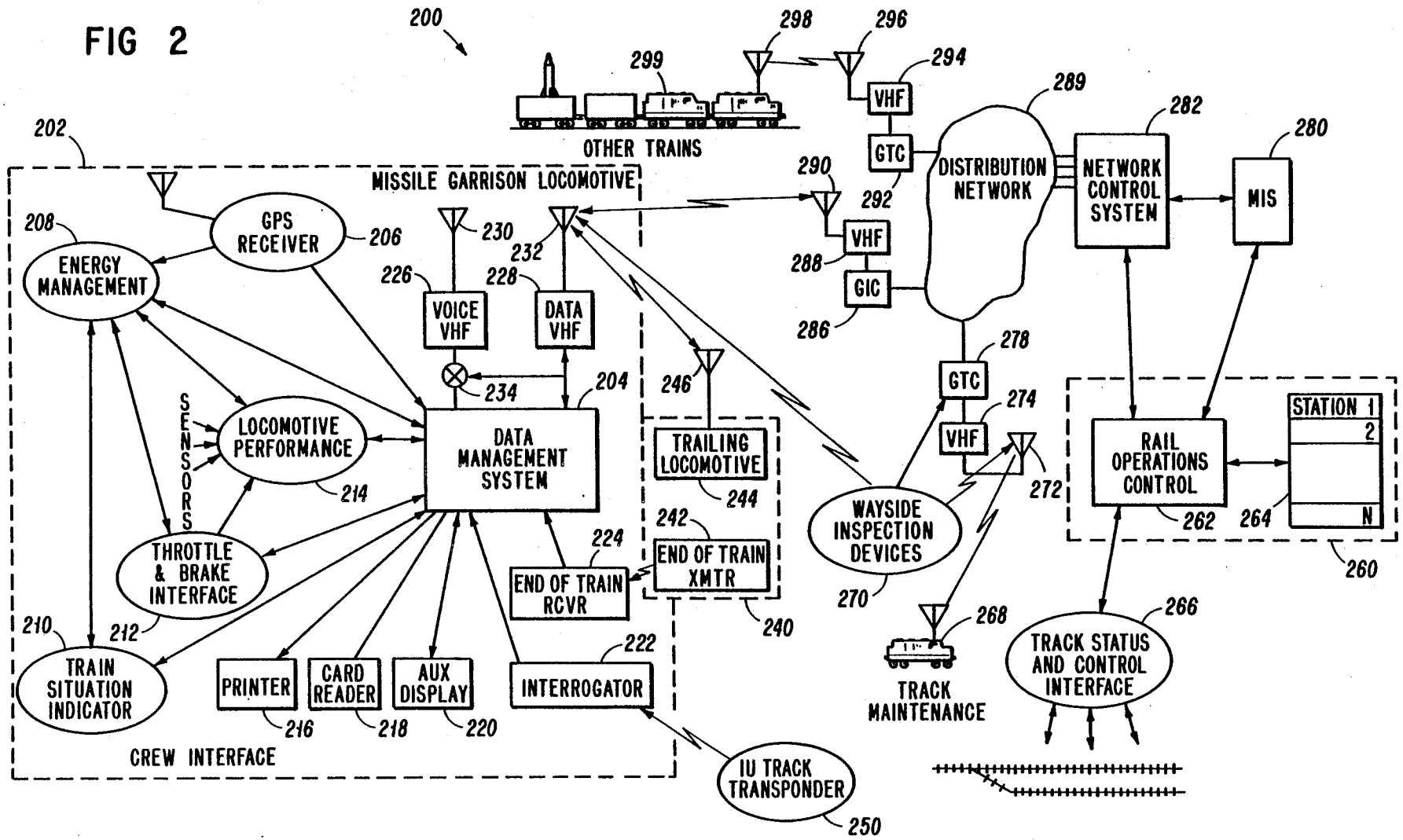

Now referring to FIG. 2, there is shown a schematic representation of the improved railroad missile garrison system, of the present invention. Intermittent line enclosure 202 represents the equipment aboard a typical missile garrison locomotive. There is shown data management system 204 for receiving, transmitting, and processing information received from various on board and external sources. GPS receiver 206 is shown for generating train position information. This position information is provided to energy management system 208 and also to other onboard systems, including other trains through the data management system 204.

Energy management system 208 determines required train speed and issues throttle/brake commands to the throttle and brake interface 212. Energy management system 208 also converts GPS receiver 206 position information to a railroad position based upon the known track parameters. Energy management system 208 further sums motive power performance data and reports excessive power usage and further generates display data which is displayed upon the train situation indicator 210. Energy management system 208 also computes the end of train position which is useful in providing the capability for positive train separation. Energy management system 208 also generates power allocation commands and performs dead reckoning in the event of a temporary loss of positioning data.

Energy management system 208 works from the supplied conditions to determine what energy is required to meet the train schedule. To perform this task, the system is supplied with data on track profile, speed limits, schedules, consist profile, motive power and any other special conditions. By scanning ahead a distance, preferably 10 miles, energy management system 208 examines the terrain to see if hills, curves, or speed restrictions, etc. should be considered to change the present energy balance. This judgment is based upon a trade-off of predetermined factors. In actual practice, the desired trade-off is determined in energy management system 208 or by rail operation control system 262.

Computed throttle and brake outputs or target speeds can be shown on the train situation indicator 210 for the crew. Alternately, the commands can be directly coupled to the controls. In summary, energy management system 208 coordinates all the available data to improve handling and increase safety.

The train situation indicator 210 is a display device for the display of visual information relating to train status, conveys commands/warnings, etc.

The throttle and brake interface 212 is a means by which the throttle and brake control (not shown) is implemented and the status is determined. The throttle and brake interface 212 provides incremental control of the throttle and brakes and reports throttle and brake status while also providing for remote intervention in the event that it is necessary in order to maintain positive train separation.

The throttle and brake interface 212 function can provide an independent direct path from the data management system 204 to the throttles and air brake control mechanism. This path can provide for remote intervention from off locomotive. This remote intervention is an important aspect in maintaining positive train separation. A decision that a particular missile garrison locomotive must stop may be made at rail operations control system 262 and transmitted through distribution network 289 and antenna 290 to antenna 232 aboard the missile garrison locomotive and communicated through data receiver 228 to data management system 204, and there to the throttle and brake interface 212, to effect the remote intervention.

Locomotive performance system 214 provides assurance of locomotive availability by including monitors, and sensors, which compute locomotive performance, report locomotive exceedances, store maintenance data, responds to requests for performance data and performs air brake validation tests. The assurance that any particular locomotive may be dispatched at the desired time is extremely important especially in view of the fact that the missile train may be in a stand-by status for extended time periods.

Printer 216, card reader 218 and auxiliary display 220 are used to prevent unauthorized movement of locomotives as well as identify and assist the locomotive crew in interfacing with the data management system 204.

The rail operation control system 262 can be a train control and dispatching system based on real time availability of all applicable information derived from various sources. The system can be a dynamic train order base control system that generates orders, monitors safety, determines compliance, optimizes traffic flow, and implements controller decisions. The mission reliability is enhanced by the rail operations control system 262, in that, the non military traffic on the rails can be regulated so that extended waiting periods for track warrants for the missile train are eliminated.

Rail operations control system 262 interfaces with network control system 282 for digital communications to and from trains. System 262 also interfaces with railroad management information system 280 to exchange digital information regarding train and locomotive status as well as to obtain the necessary operational parameters required for precise train control, such as, schedules, track and train data, etc. Additionally, system 262 is connected to various track interfaces to accommodate required track status and control functions. Stations 264 are manned by controller persons who make the ultimate decisions on controlling the data supplied to the various trains throughout the system.

Distribution network 289 is coupled with network control system 282 and there to the rail operation control system 262. Distribution network 284 also is coupled to a plurality of ground terminal computers 278, 286, and 292 with their associated radio transceivers 274, 288, and 294, respectively, and antennas 272, 290, and 296, respectively. These ground terminal control computers and their associated transceivers are utilized for receiving and transmitting digital information to the data management system aboard the locomotives and are associated also with the wayside inspection devices 270 which are located at various points along the tracks, and provide track status information and train inspection information.

In operation, the improved railroad missile garrison system of the present invention enhances the safety of the local civilian population in three predominant manners.

First of all, the likelihood of a train to train collision is reduced by maintaining positive train separation at all times. This is essentially accomplished by computing the position of the several trains which are operated upon the system and communicating this train position information back to the rail operations control system 262. This information is used in controlling traffic and issuing warrants. In the rare event that remote intervention is necessary to prevent a collision, a command can be originated from station 264 through rail operations control system 262 and eventually will be received by data management system 204 aboard the missile garrison locomotive.

Secondly, due to terrorism, vandalism or sabatage, it may be necessary to immediately stop and prevent further progress of the locomotive. In this case an appropriate signal can be output from data management system 204 to the throttle and brake interface 212 and the remote brake intervention thereby assures an alert response. Likewise, if for some reason it is necessary to automatically increase the throttle, then a similar message can also be transmitted to data management system 204 and executed by the throttle and brake interface 212, thereby providing for remote throttle intervention.

Thirdly, the improved railroad missile garrison system of the present invention helps to reduce the likelihood of missile train derailments by providing commands by way of the train situation indicator 210 to the crew or by way of providing automatic throttle and brake intervention through the throttle and brake interface 212. Information on the location of the locomotive as well as the track status and condition is utilized in the rail operations control system 262 to generate commands which will eventually and ultimately provide for the throttle control of the locomotive and thereby reduce the locomotive speed and eliminate the dangers of operation at excessive speeds.

It is thought that the improved railroad missile garrison system of the present invention and many of its attendent advantages will be understood from the foregoing description, and it will be apparent that various changes may be made in the form, construction, and arrangement of the parts thereof without departing from the spirit and scope of the invention, or sacrificing all their material advantages, the forms here and before described being merely preferred or exemplary embodiments thereof.

I claim:

1. An improved railroad missile garrison system, that launches ICBMs from rail cars operated over an expansive geographic region, on a rail network that also carries nonmilitary trains; the missile garrison system comprising:

at least one railroad missile launch car for transporting and launching said ICBM's, from remote locations;

at least one locomotive having a geographic position, coupled with said at least one railroad missile launch car for providing motive force necessary for travel about the rail network;

means on-board said locomotive, for generating locomotive position signals in response to the geographic position of said locomotive;

a communication system, on-board said locomotive, for communicating said locomotive position signal to various users about the rail network;

said communication system further receiving track information signals, from sources off-board the locomotive, relating to a status of tracks in the rail network; and means for automatically causing said locomotive to stop, in response to a predetermined track information signal;

means for automatically causing the locomotive to change throttle position, in response to a second predetermined track information signal, WHEREBY, the missile launch car, with ICBM thereon, can be automatically stopped and accelerated at remote locations about the rail network so that collisions can be avoided, derailments reduced and threats from sabotage, vandalism and terrorism minimized.

* * * * *